US006866549B2

(12) United States Patent
Kimura et al.

(10) Patent No.: US 6,866,549 B2
(45) Date of Patent: Mar. 15, 2005

(54) ELECTRICAL CONNECTOR ASSEMBLY

(75) Inventors: Takeshi Kimura, Kanagawa (JP); Kazuya Orui, Kawasaki (JP); Kunihiko Shimizu, Kawasaki (JP); Hiroyuki Otaguro, Kawasaki (JP); Rie Takada, Kawasaki (JP)

(73) Assignees: Tyco Electronics AMP K.K., Kanagawa (JP); Fujitsu Limited, Kanagawa (JP)

( * ) Notice: Subject to any disclaimer, the term of this patent is extended or adjusted under 35 U.S.C. 154(b) by 0 days.

(21) Appl. No.: 10/805,041

(22) Filed: Mar. 19, 2004

(65) Prior Publication Data

US 2004/0185716 A1 Sep. 23, 2004

(30) Foreign Application Priority Data

Mar. 20, 2003 (JP) ..... 2003-078284

(51) Int. Cl.[7] ..... H01R 13/502
(52) U.S. Cl. ..... 439/701; 439/608
(58) Field of Search ..... 439/701, 608, 439/374, 79, 377, 378, 680, 674, 677

(56) References Cited

U.S. PATENT DOCUMENTS 5,702,258 A 12/1997 Provencher et al.
6,384,341 B1 5/2002 Rothermel et al. ..... 174/255
6,390,857 B1 * 5/2002 Pickles et al. ..... 439/680
6,461,202 B2 * 10/2002 Kline ..... 439/701
6,695,627 B2 * 2/2004 Ortega et al. ..... 439/78
6,739,918 B2 * 5/2004 Cohen et al. ..... 439/701
6,764,349 B2 * 7/2004 Provencher et al. ..... 439/701
2002/0137400 A1 * 9/2002 Billman et al. ..... 439/701

FOREIGN PATENT DOCUMENTS

EP 0 560 551 A1 9/1993
JP 3058235 3/1999
WO WO 99/09616 2/1999

* cited by examiner

*Primary Examiner*—Tho D. Ta
(74) *Attorney, Agent, or Firm*—Barley Snyder

(57) ABSTRACT

The present invention relates to an electrical connector assembly capable of achieving a high-precision fit starting with fairly rough positioning, the assembly consisting of a first connector which is equipped with multiple substrates secured in an array and a second connector which is equipped with female terminals and mates with the first connector. The electrical connector has a rough guide mechanism (first guides and second guides as well as first complementary guides and second complementary guides) which guides a mating between the first connector and the second connector relatively roughly at an initial stage of mating, and a precision guide mechanism (chamfers on substrates and corresponding tapers on a housing of the second connector) which guides the mating between the first connector and the second connector relatively precisely at an advanced stage of mating.

2 Claims, 17 Drawing Sheets

ELECTRICAL CONNECTOR ASSEMBLY

FIELD OF THE INVENTION

The present invention relates to an electrical connector assembly having a first connector equipped with multiple substrates secured in an array and a second connector equipped with female terminals for mating with the first connector.

BACKGROUND OF THE INVENTION

Electrical connector assemblies which consist of a first connector having multiple substrates known as chicklets secured in an array and a second connector equipped with female terminals have been used for electrically connecting multiple circuit boards. For example, a circuit board called a mother board and a circuit board known as a daughter board may be electrically connected to each other in this manner. U.S. Pat. No. 6,384,341, hereinafter '341, discloses an electrical connector assembly which consists of a first connector having multiple terminals, multiple substrates equipped with lands connected to the terminals and contact sections to be connected to a mating connector. A first housing supports the plural substrates in an array. A second connector has a second housing for supporting multiple female terminals which engage the contact sections of the substrates. The electrical connector assembly disclosed in the '341 patent is also equipped with a guide mechanism which positions the first connector and second connector precisely relative to each other when they are mated.

Japanese Registered Utility Model No. 3058235, hereinafter JP 3058235 discloses an electrical connector assembly having a pair of mateable electrical connectors. The plug connector is equipped at its longitudinal ends with guide projections and the receptacle has recesses for receiving the guide projections during mating.

These types of electrical connector assemblies in which male contact sections consisting of substrates (chicklets) are connected with female terminals of the mating connector have a low tolerances for position errors during mating. Thus, the first connector and second connector must be aligned fairly precisely before mating. Then, final positioning is performed accurately with the help of the guide mechanism attached to the electrical connector assembly.

However, the technique disclosed in the '341 patent requires a high level of accuracy to position the guide mechanism from the initial stage of mating. If the two connectors are mated or urged toward each other before they are precisely aligned, one of the connectors may be broken.

On the other hand, the technique disclosed in JP 3058235 provides a fairly rough guide and permits fairly large errors in the positioning of the two connectors in the initial stage of mating. In that respect, positioning is improved because little positioning accuracy will do. However, a guide mechanism which provides this level of rough guide does not have sufficient precision when used in a connector having substrates (chicklets) forming male contacts.

The present invention has been made in view of the above circumstances and has an object to provide an electrical connector assembly which can achieve a high-precision fit starting with fairly rough positioning.

SUMMARY OF THE INVENTION

To achieve this and other objects, the present invention is an electrical connector assembly which has a first connector having multiple terminals, multiple substrates equipped with land patterns connected to the terminals and contact sections to be connected to a second connector for mating. A first housing supports the multiple substrates in an array. A second connector has multiple female terminals which engage the contact sections of the boards, and a second housing supports the female terminals. The electrical connector assembly has a rough guide mechanism which guides a mating between the first connector and second connector relatively roughly at an initial stage of mating and a precision guide mechanism which guides the fit between the first connector and second connector relatively precisely at an advanced stage of mating.

In the electrical connector assembly, the rough guide mechanism may have first guides installed at two locations at a certain distance from each other on a first side wall of the first housing, second guides installed on the first housing at two locations on a second side wall opposite the first side wall, being separated by a distance different from the distance between the first guides. First complementary guides and second complementary guides are located in the second housing corresponding to the first guides and the second guides, respectively. The precision guide mechanism may also have chamfers created on those corners of the boards for the first connector which are on the side of the contact sections and tapers created on the second housing corresponding to the chamfers.

BRIEF DESCRIPTION OF THE DRAWINGS

The invention will now be described by way of example with reference to the accompanying figures of which.

DETAILED DESCRIPTION OF THE PREFERRED EMBODIMENTS

Embodiments of the present invention will be described below with reference to the drawings.

Figure 1:
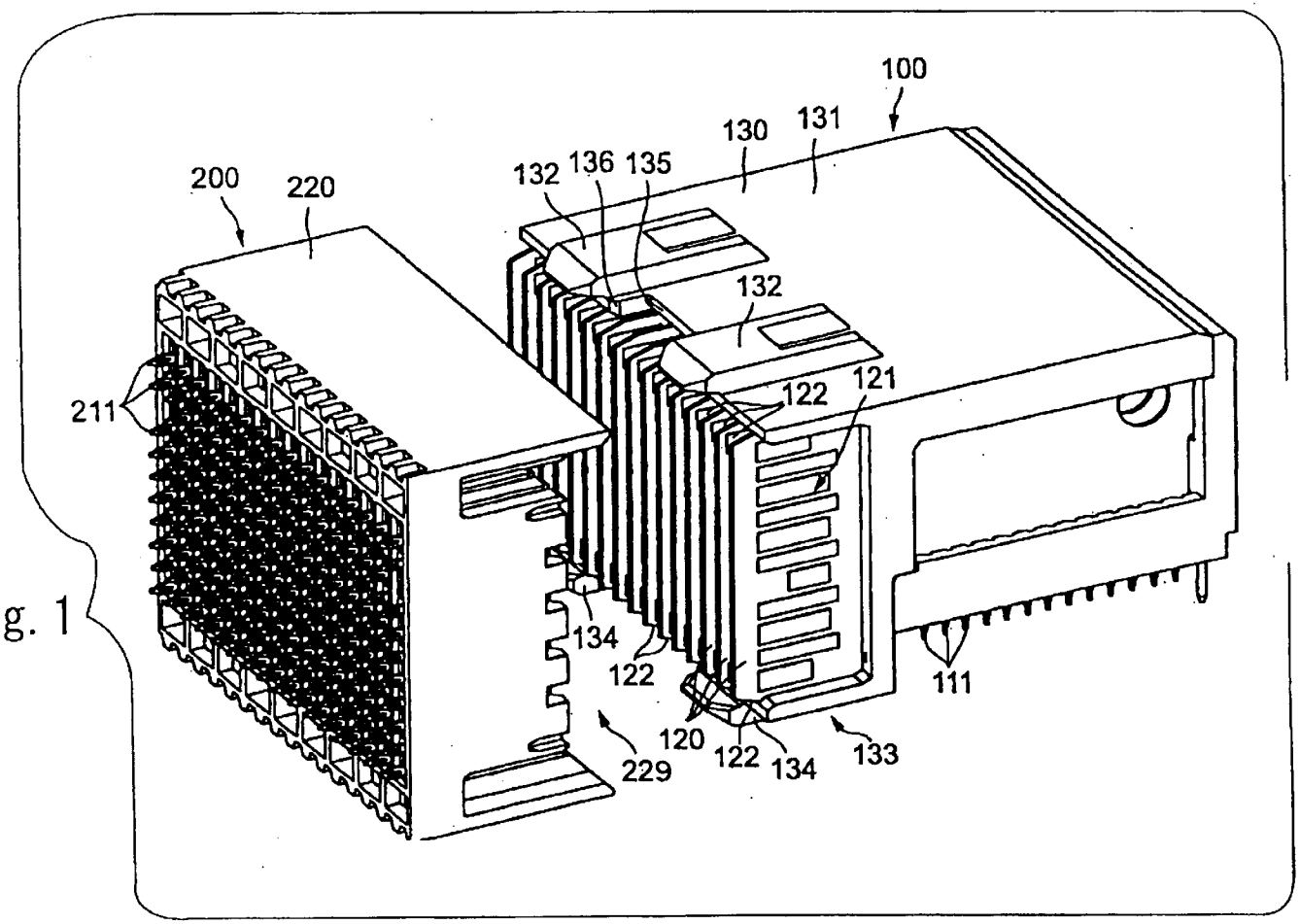
FIG. 1 is a perspective view showing an electrical connector assembly having first and second mateable connectors according to an embodiment of the invention.
Figure 9:
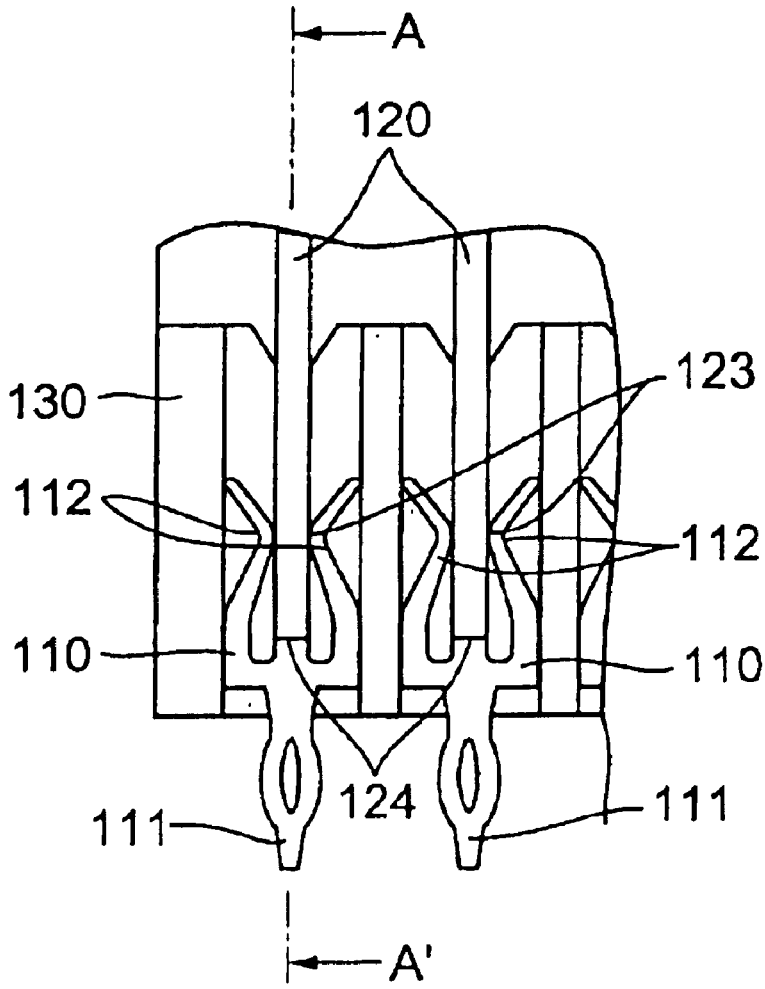
FIG. 9 is a schematic diagram showing an enlarged view of terminals in the first connector.

Referring to FIGS. 1 and 9, the first connector 100 includes terminals 110 equipped with compliant pins 111 which are received in through-holes of a daughter board (not shown), multiple substrates (chicklets) 120 arranged in an array, and a housing 130 which secures the multiple substrates 120 in an array.

Figure 3:
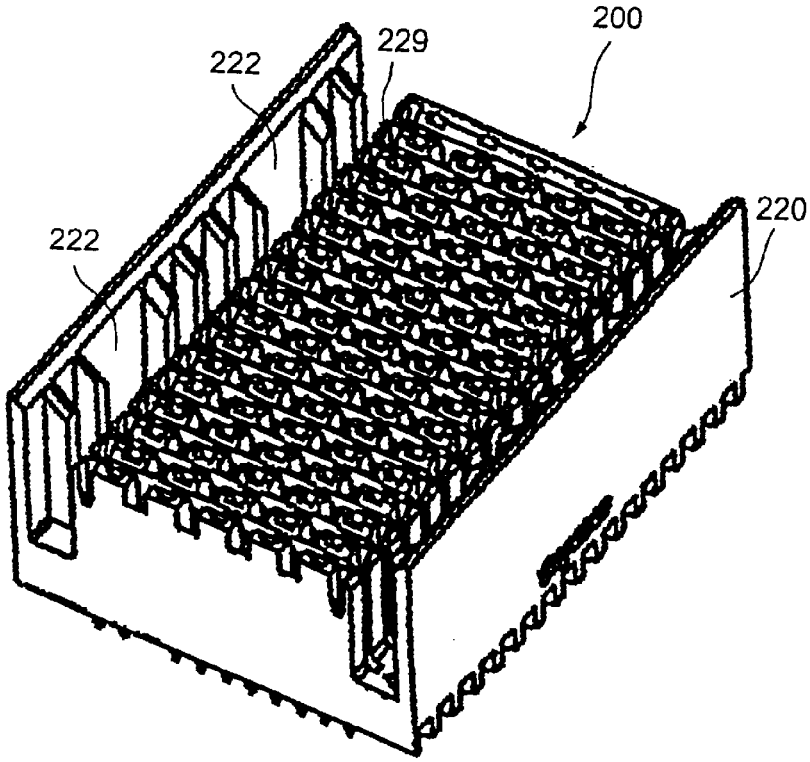
FIG. 3 is a perspective view of the second connector taken from the mating end.
Figure 11:
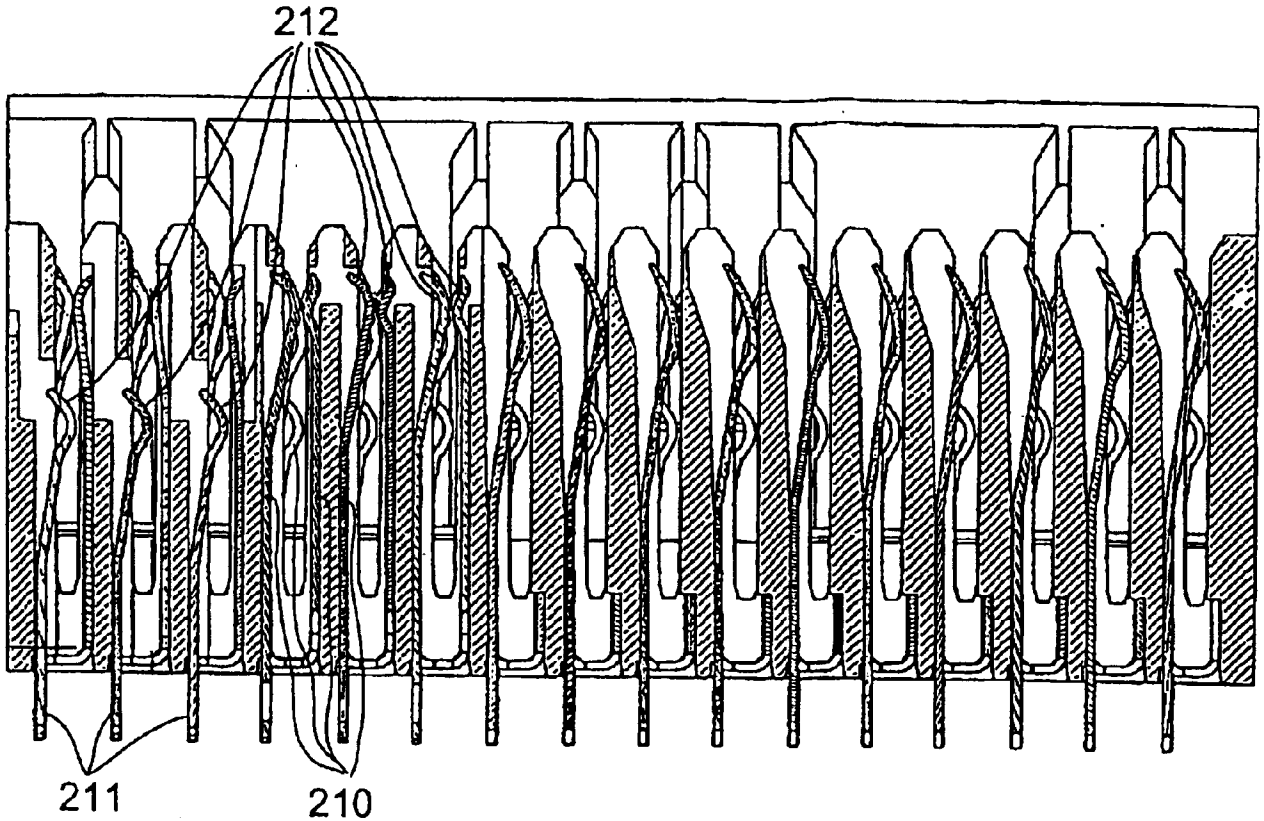
FIG. 11 is an enlarged sectional view of the second connector taken along B–B' line of FIG. 4.

The second connector 200 as shown in FIGS. 1, 3 and 11 is provided with compliant pins 211 received in through-holes of a motherboard to be connected with the daughter board via the first and second connectors 100 and 200. It includes, multiple female terminals 210 which engage contact sections 121 (see FIG. 7) provided on the substrates 120 of the first connector 100 and a housing 220 which secures the multiple female terminals 210 and has a mating surface 229 (see FIG. 3) to accept the first connector 100.

Figure 2:
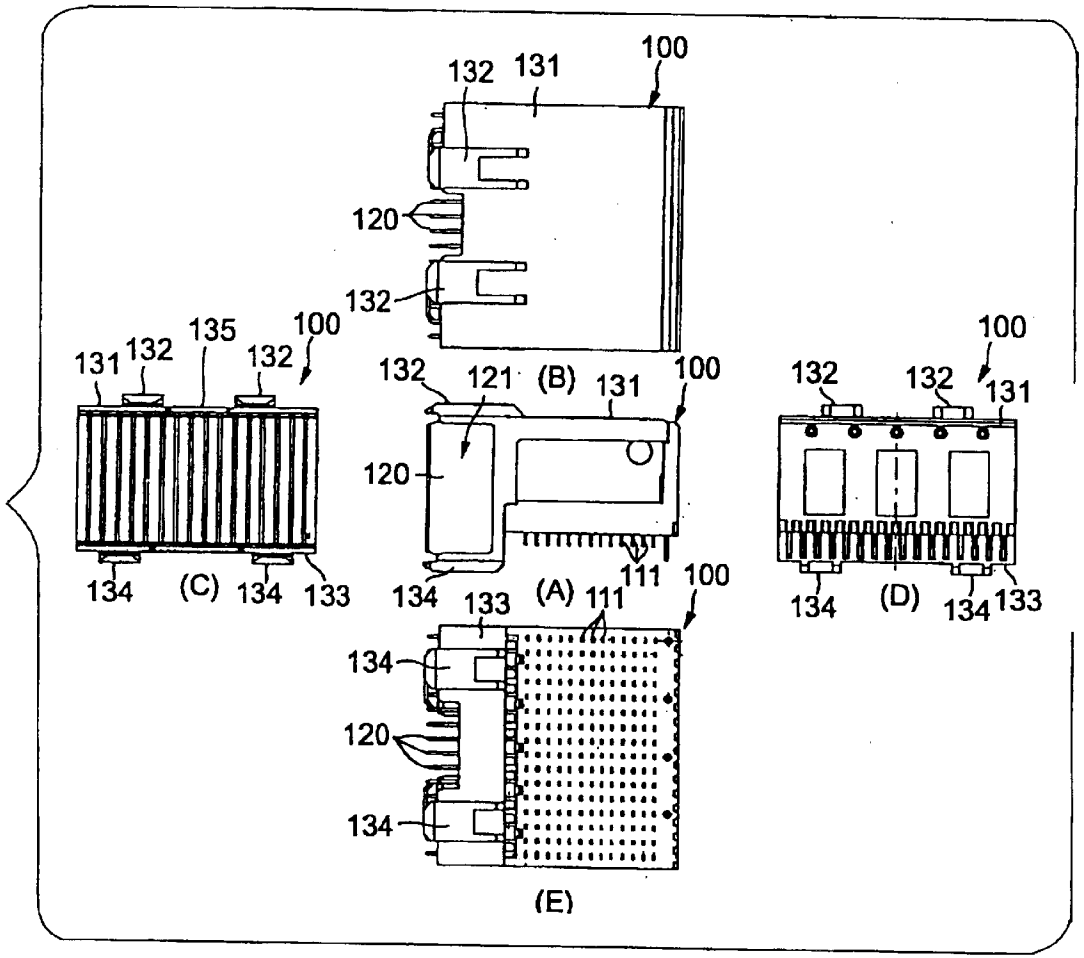
FIGS. 2(A)–(E) are a front view, plan view, left side view, right side view, and bottom view, respectively, of the first connector.

The terminals 110 of the first connector 100 are arranged in a two-dimensional array as can be seen from their respective compliant pins 111 shown in Part (E) of FIG. 2. Accordingly, a large number of through-holes are formed in the daughter board (not shown) to accept the compliant pins 111.

The substrates 120 of the electrical connector 100 are arranged in the vertical direction in FIG. 2(E) and each of them is connected to a corresponding horizontal row of terminals from among the large number of terminals 110 in the two-dimensional array in FIG. 2(E). Structure of connection between the substrates 120 and terminals 110 will be described below.

As shown in FIG. 1, the contact section 121 is formed on the mating end of each substrate 120 which is mated with the female terminals 210 (see FIG. 11) on the second connector 200. On that mating end having the contact section 121, corners of each substrate 120 have a chamfer 122. The chamfers 122 are used for vertical positioning of the substrates 120 in FIG. 1 when the first connector 100 and second connector 200 are mated.

Also, in the housing 130 of the first connector 100, first guides 132 are formed on an top wall 131 as shown in FIG. 1 and second guides 134 are formed on a bottom wall 133.

Figure 4:
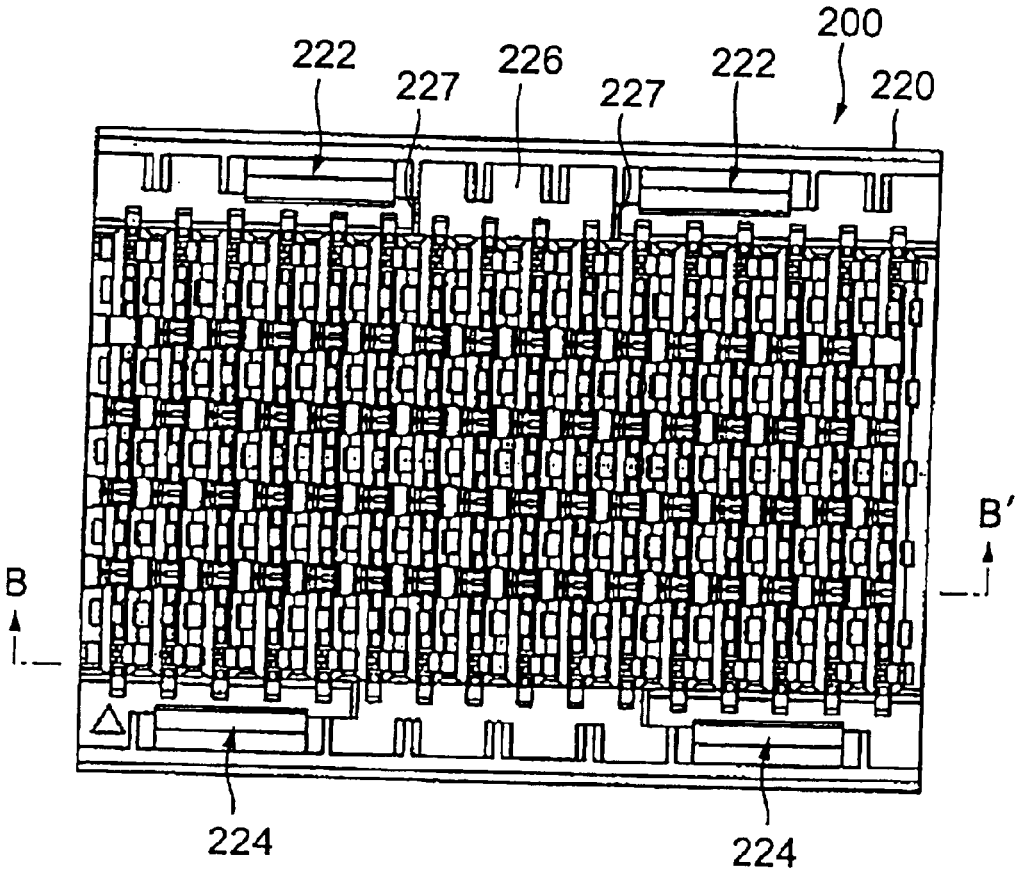
FIG. 4 is a plan view of the second connector taken from the mating end.

The first guides 132 are installed at two locations on the top wall 131 at a certain distance from each other and the second guides 134 are installed at two locations on the bottom wall 133 separated by a distance different from the distance between the first guides 132 on the top wall 131. As shown in FIGS. 3 and 4, in the housing 220 of the second connector 200, a pair of first complementary guides 222 and a pair of second complementary guides 224 are disposed at locations which correspond, respectively, to the locations of the pair of first guides 132 and the pair of second guides 134 on the housing 130. The first guides 132 and second guides 134 together with the corresponding first complementary guides 222 and second complementary guides 224 constitute a rough guide mechanism which roughly guides the mating between the first connector 100 and second connector 200 at the initial stage of mating.

For facilitating alignment during mating, the second connector 200 has tapers 221 (see FIGS. 12 and 13) at locations which correspond to the chamfers 122, formed on top and bottom corners of the contact section 121 of the first connector 100. The chamfers 122 and tapers 221 cooperate to form a precision guide mechanism which guides the mating between the first connector 100 and second connector 200 more precisely than the rough guide mechanism in an advanced stage of mating.

As shown in FIG. 1, a recess 135 is formed between the first guides 132 in the housing 130 of the first connector 100. Chamfers 136 are formed at the entrance corners of the recess 135. The second connector 200 has a protrusion (described later) in the depth between the first complementary guides 222 which correspond to the first complementary guides 132 of the first connector 100. The protrusion is formed at a location which corresponds to the recess 135 and enters the recess 135 when the first connector 100 and second connector 200 are mated. Corners of the protrusion are tapered corresponding to the chamfers 136 on the entrance corners of the recess 135.

The recess 135 between the first guides 132 of the first connector 100 as well as the corresponding protrusion on the second connector 200 are constituent parts of the precision guide mechanism.

Thus, at the initial stage of mating, the first connector 100 and second connector 200 are mated by being roughly guided as the first guides 132 and second guides 134 of the first connector 100 enter the first complementary guides 222 and second complementary guides 224 of the second connector 200. The distance between the two first guides 132 (and the corresponding two first complementary guides 222) differs from the distance between the two second guides 134 (and the corresponding two second complementary guides 224) to prevent the connectors from being mated upside down by mistake.

Figure 12:
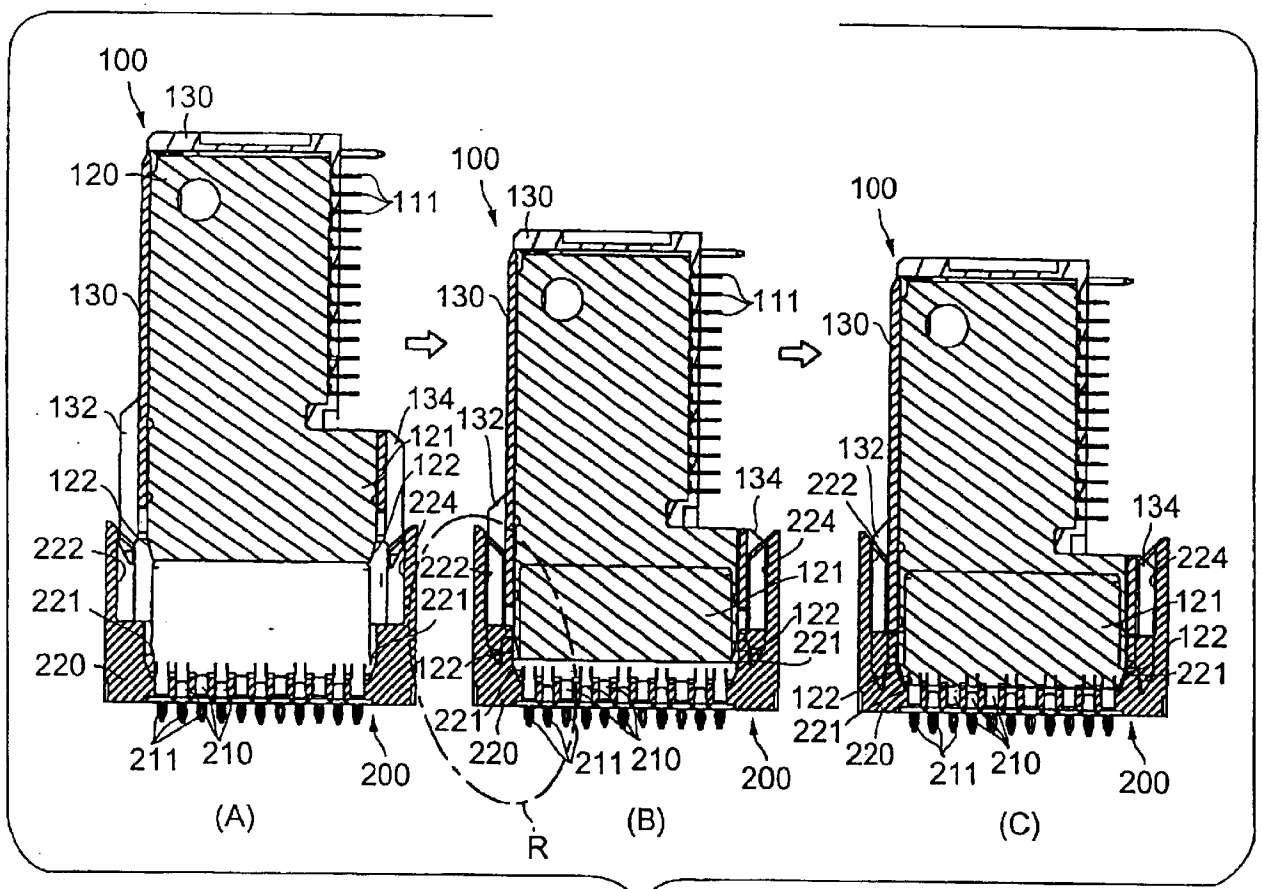
FIG. 12 is a sectional view showing a progression of the first connector and second connector during mating.

In an advanced stage of mating as shown in FIG. 12, a vertical precision guide is provided by the beveled edges 122 formed on the corners of the contact sections 121 of the substrates 120 in the first connector 100 in conjunction with the corresponding tapers 221 on the housing 220 of the second connector 200 while a horizontal precision guide is provided by the recess 135 formed between the two first guides 132 on the housing 130 of the first connector 100 and the corresponding protrusion (described later) formed in the housing 220 of the second connector 200. Thus, at the initial stage, mating is started even if the first connector 100 and second connector 200 are positioned more or less imprecisely, and at the advanced stage, precision mating is done with the help of the precision guide mechanism described above.

Figure 7:
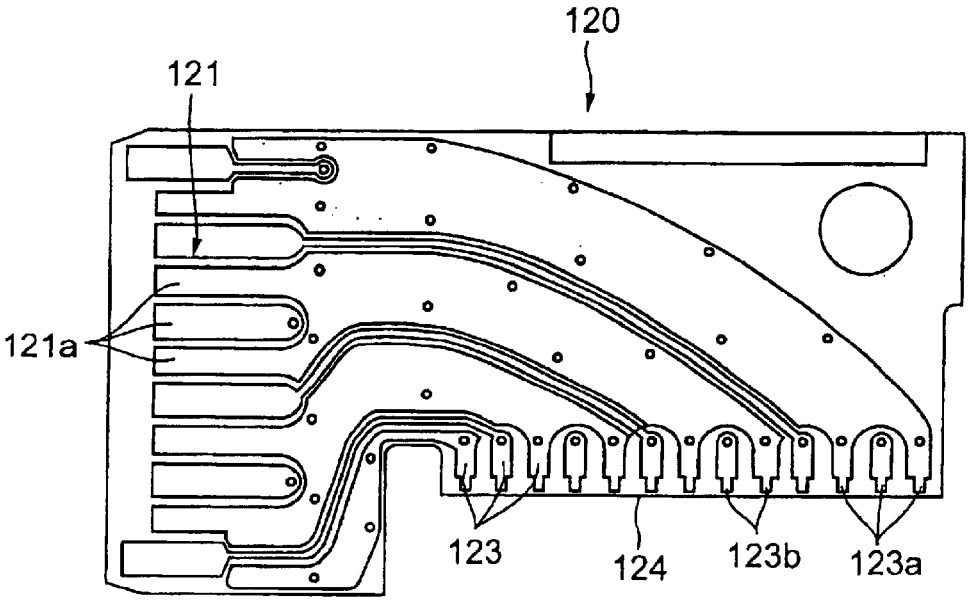
FIG. 7 is a diagram showing a first surface of a substrate in the first connector.
Figure 8:
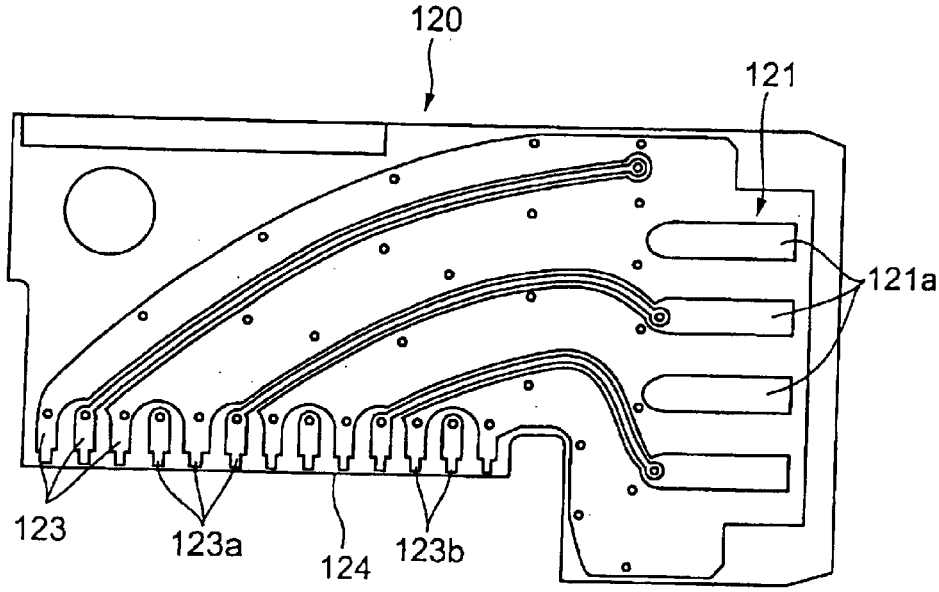
FIG. 8 is a diagram showing a second surface of the substrate.

Referring to FIGS. 7 and 8, the substrate 120 contains the contact section 121 along an edge which is to be inserted in the second connector 200 (see FIG. 1) as well as multiple lands 123 arranged along a second edge 124 of the substrate. Lands 123 consist of conductor patterns formed on an insulator which is the base material of the substrate 120. Each land 123 is connected to a respective contact 121*a* arranged on the contact section 121.

Each land 123 extends close to the second edge 124 of the substrate. As shown in FIGS. 7 and 8, only a small area consisting solely of an insulator remains between the second edge 124 and a bottom edge 123*b* of the lands 123. The reason why the area-consisting solely of an insulator is left on the second edge 124 of the substrate 120 is to eliminate the possibility of peeling off the lands 123 when cutting the substrate 120 from a large wafer.

That part of each land which is close to the second edge 124 of the substrate 120 is narrower than the other part of the land 123. The lands 123 are connected with respective terminals 110 (see FIGS. 1 to 3) of the first connector 100 as described later. The part of each land which is close to the edge 124 of the substrate 120 is narrower than the other part of the land 123 to optimize insulation distance between the land pattern 123 and the terminals 110 connected to the adjacent land patterns 123. This will be further described later.

Figure 5:
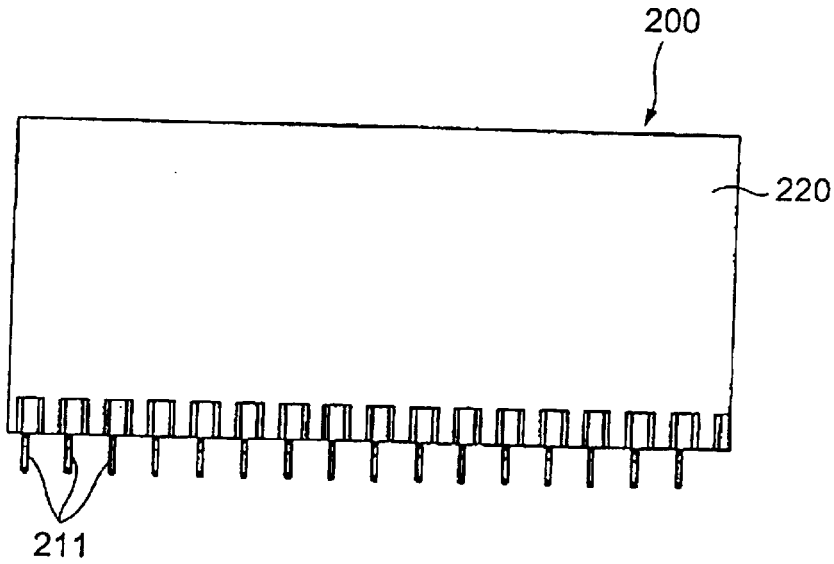
FIG. 5 is a front view of the second connector.
Figure 6:
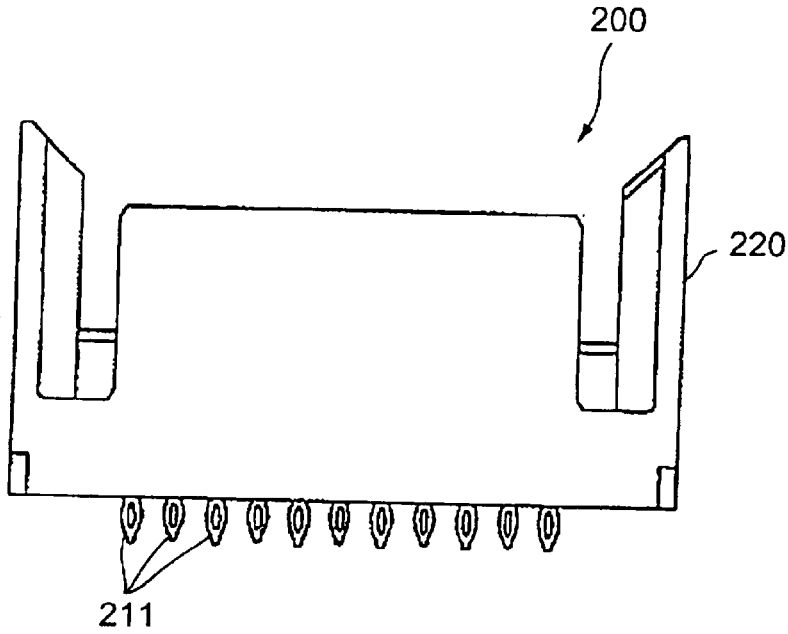
FIG. 6 is a side view of the second connector.
Figure 10:
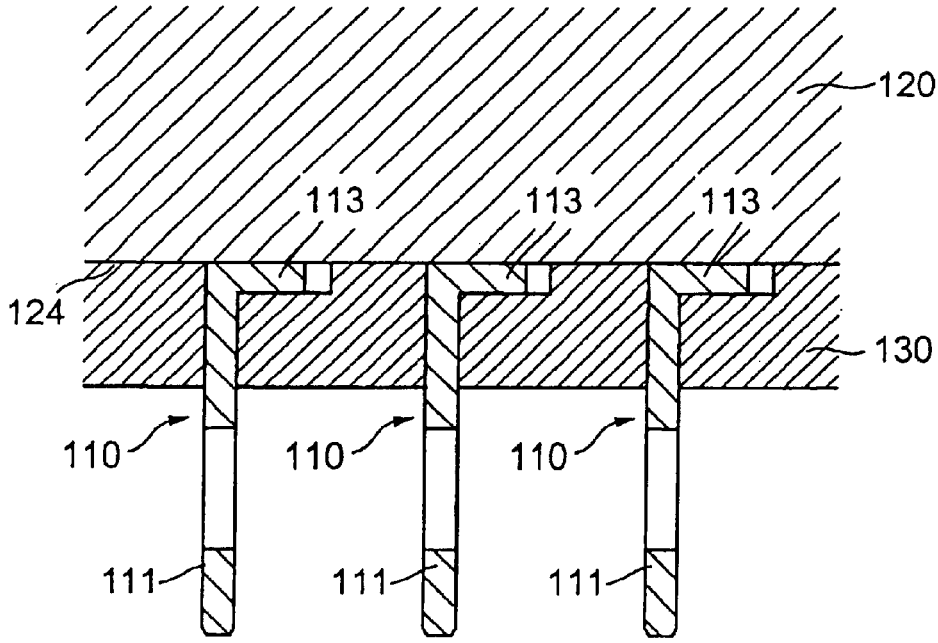
FIG. 10 is a sectional view taken along A–A' line of FIG. 9.

FIGS. 9 and 10 show terminals 110 each of which has a compliant pin 111 to be inserted into a through-hole in the main board (not shown). A fork-shaped contact 112 is formed on that part of the terminal 110 which is located inside the first connector housing 130 to receive a respective land 123 (see FIGS. 4 and 5) of the substrate 120. Also, a substrate support 113 (see FIG. 10) is formed on that part of the terminal 110 which contacts the second edge 124 of the substrate 120. It is bent into the depth of the diagram in FIG. 6 and extends along the edge 124 of the substrate 120.

The terminals 110 of this shape are arranged two-dimensionally in the housing 130 as shown in FIG. 2(E). When the first connector 100 is assembled, the lands 123 of the substrates 120 are inserted into the contacts 112 of the terminals 110 secured in the housing 130.

As shown in FIG. 10, the substrate supports 113 of the terminals 110 support the lower end of each substrate 120 when the compliant pins 111 are inserted into the through-holes in the main board. They serve to distribute the pressure placed by the terminals 110 on the substrates 120, reducing buckling of the second edge 124 of each substrate 120, when the terminals are inserted. However, the pressure distribution effect of the substrate supports 113 alone cannot completely prevent the second edges 124 of the substrates 120 from buckling. Thus, as described with reference to FIGS. 7 and 8, the lands 123 formed on the substrates 120 are extended close to the second edge 124 of each substrate 120. The lands 123 reinforce the part around the second edge 124 of each substrate 120, and thereby prevent the bottom edges 124 of the substrates 120 from being buckled. Consequently, the first connector 100 can be mounted into the through-holes in the main board (daughter board) with high reliability.

Each substrate support 113 of the terminal 110 extends to near the adjacent land 123 along the bottom edge 124 of the substrate 120 as shown in FIG. 10. If the tip of the substrate support 113 is too close to the lower end of the adjacent land 123, it may become difficult to ensure insulation between the adjacent lands 123, resulting in a lowered threshold voltage. To avoid this situation, that part of the land pattern 123 which is close to the second edge 124 of the substrate 120 is narrowed to keep clear of the substrate support 113 of the terminal 110.

The second connector 200 as shown in FIG. 11 is mountable on the motherboard. FIG. 11 shows an array of multiple female terminals 210 equipped with compliant pins 211 to be inserted into through-holes in the motherboard as well as with contacts 212 which receive the substrates 120 of the first connector 100. The female terminals are cross sectioned in different planes between the left part and right part of FIG. 11 (See split section line B–B' in FIG. 4) so that two types of female terminal 210, long and short, are shown in the figure.

When the first connector 100 and second connector 200 are mated, the contact sections 121 (see, for example, FIG. 1) provided on the substrates 120 of the first connector 100 are accepted into the contacts 212 of the female terminals 210 on the second connector 200, establishing electrical connections between the contact pads 121*a* in the contact sections 121 of the substrates 120 and the female terminals 210.

Mating of the first and second connectors 100, 200 will now be described in greater detail with reference to FIG. 12. FIG. 12(A) is a diagram showing an initial stage of mating. At this stage, the first connector 100 and second connector 200 are mated by being guided as the first guides 132 and second guides 134 in the housing 130 of the first connector 100 are accepted by the first complementary guides 222 and second complementary guides 224 in the housing 220 of the second connector 200. A fairly rough guide mechanism is provided by the first complementary guides 132 and second complementary guides 134 together with the first complementary guides 222 and second complementary guides 224 in order to ensure a reliable guide even if the first connector 100 and second connector 200 are misaligned to some extent.

FIG. 12(B) shows a more advanced stage of mating than FIG. 12(A) while FIG. 12(C) shows a completely mated state. What is noteworthy in an advanced state of mating is the chamfers 122 on the corners of the contact sections 121 of the substrates 120 and the corresponding tapers 221 on the housing 220 of the second connector 200. The chamfers 122 and tapers 221 are constituent parts of the precision guide mechanism according to the invention.

When the mating process proceeds from FIG. 12(B) to FIG. 12(C), with the chamfers 122 guided by the tapers 221, the contact sections 121 of the substrates 120 are guided accurately in the left-to-right direction in FIG. 12 (up-to-down direction in FIG. 1) and positioned in relation to the female terminals 210 with high precision.

Figure 14:
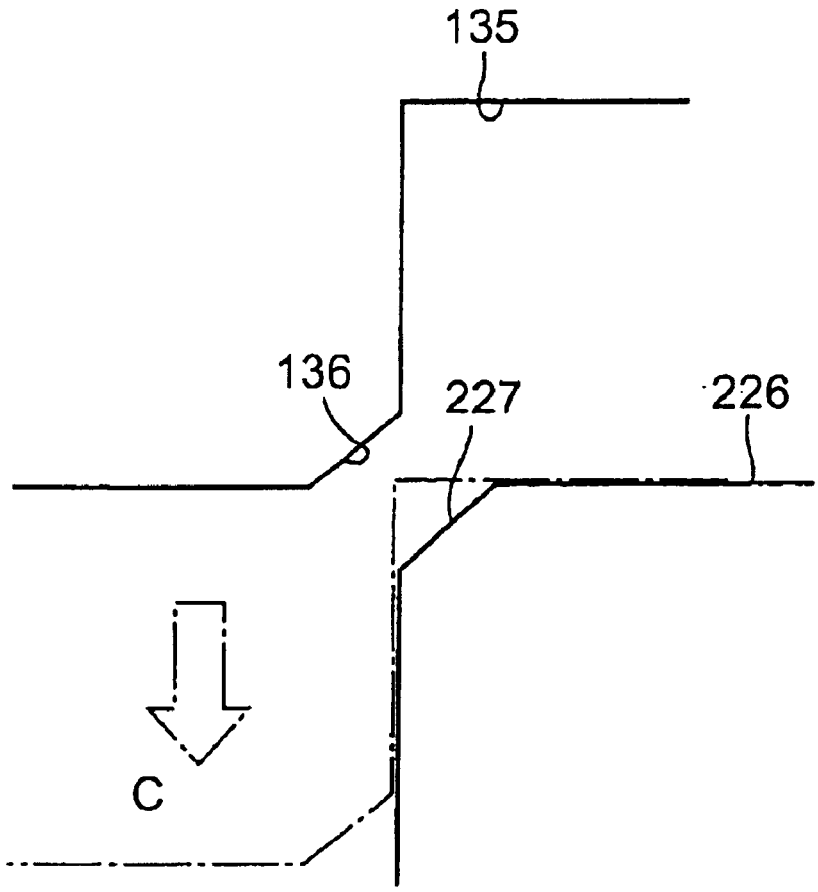
FIG. 14 is a schematic diagram showing another precision guide mechanism.

FIG. 14 is a schematic diagram showing another precision guide mechanism.

Figure 13:
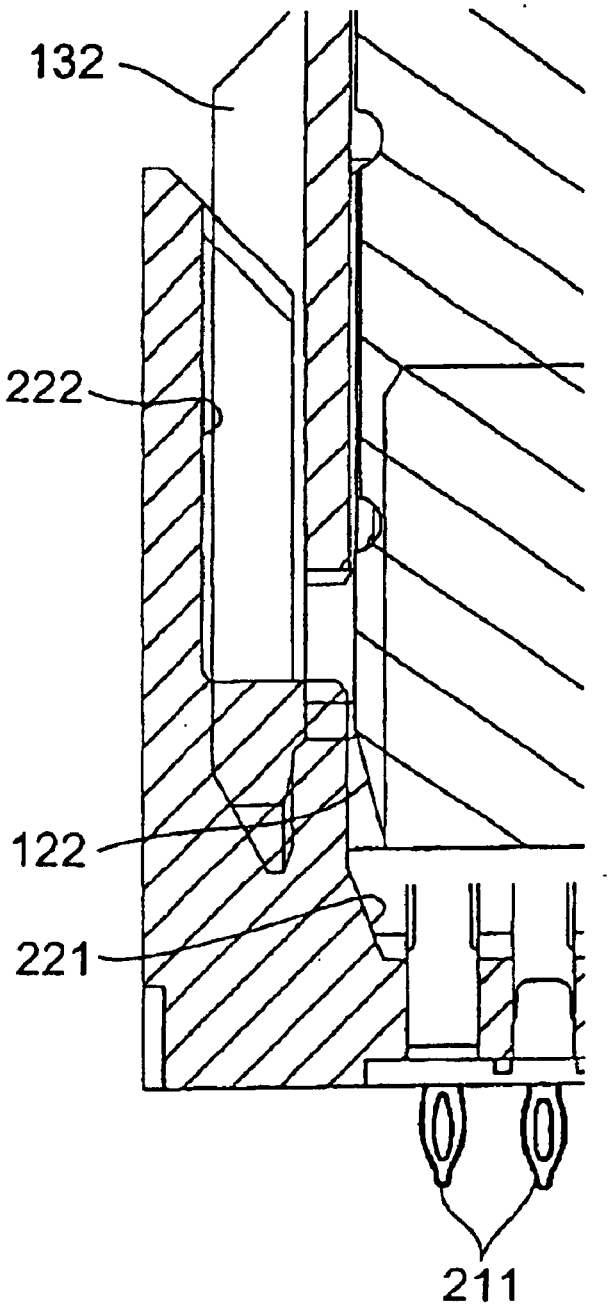
FIG. 13 an enlarged view of the encircled part R in FIG. 12.

Whereas the precision guide mechanism described with reference to FIGS. 12 and 13 provides a precision guide along the plane of the diagram in FIG. 12 (horizontal direction in FIG. 12), the precision guide mechanism in FIG. 14 provides a precision guide in the direction perpendicular to that of FIG. 12.

As shown in FIG. 1, the two first guides 132 are formed on the top wall 131 of the housing 130 of the first connector 100, a recess 135 is formed between the first guides 132, and the entrance corners of the recess 135 are formed with chamfers 136.

FIG. 14 also shows the recess 135 and chamfers 136 schematically.

As the first connector 100 moves to mate with the second connector 200, the recess 135 moves in the direction of arrow C in FIG. 14.

A protrusion 226 is formed in the depth between the first complementary guides 222 (see FIG. 3) in the housing 220 of the second connector 200, corresponding to the recess 135 (see also FIG. 4), and corners of the protrusion 226 are tapered 227. Although FIG. 14 shows only the left halves of the recess 135 and protrusion 226, the right halves have shapes symmetrical to those shown in FIG. 14. Thus, if the relative position of the recess 135 and protrusion 226 is displaced even slightly in the horizontal direction in FIG. 14, the position is adjusted by the chamfers 136 and tapers 227. Then, the mating proceeds in horizontal alignment in FIG. 14 and finally the protrusion 226 fits into the recess 135 as indicated by the dashed line in FIG. 14.

In this way, according to this embodiment, while the rough guide mechanism consisting of the first complementary guides 132 and second complementary guides 134 and the first complementary guides 222 and second complementary guides 222 (described with reference to FIG. 12) allows rough positioning at the initial stage of mating, the precision guide mechanism consisting of the chamfers 122 on the substrates 120 and the corresponding tapers 221 on the housing 220 of the second connector 200 (described with reference to FIG. 12) and the recess 135 in the housing 130 of the first connector 100 and the protrusion 226 in the housing 220 of the second connector 200 (described with reference to FIG. 14) provides a precision guide in two directions (both X and Y directions) orthogonal to the mating direction (Z direction) and accurately adjusts the position of mating between the first connector 100 and second connector 200. Thus, a large displacement between the two connectors is permitted in the initial stage of mating and precise positioning is performed as the mating proceeds to provide a highly reliable fit.

Figure 15:
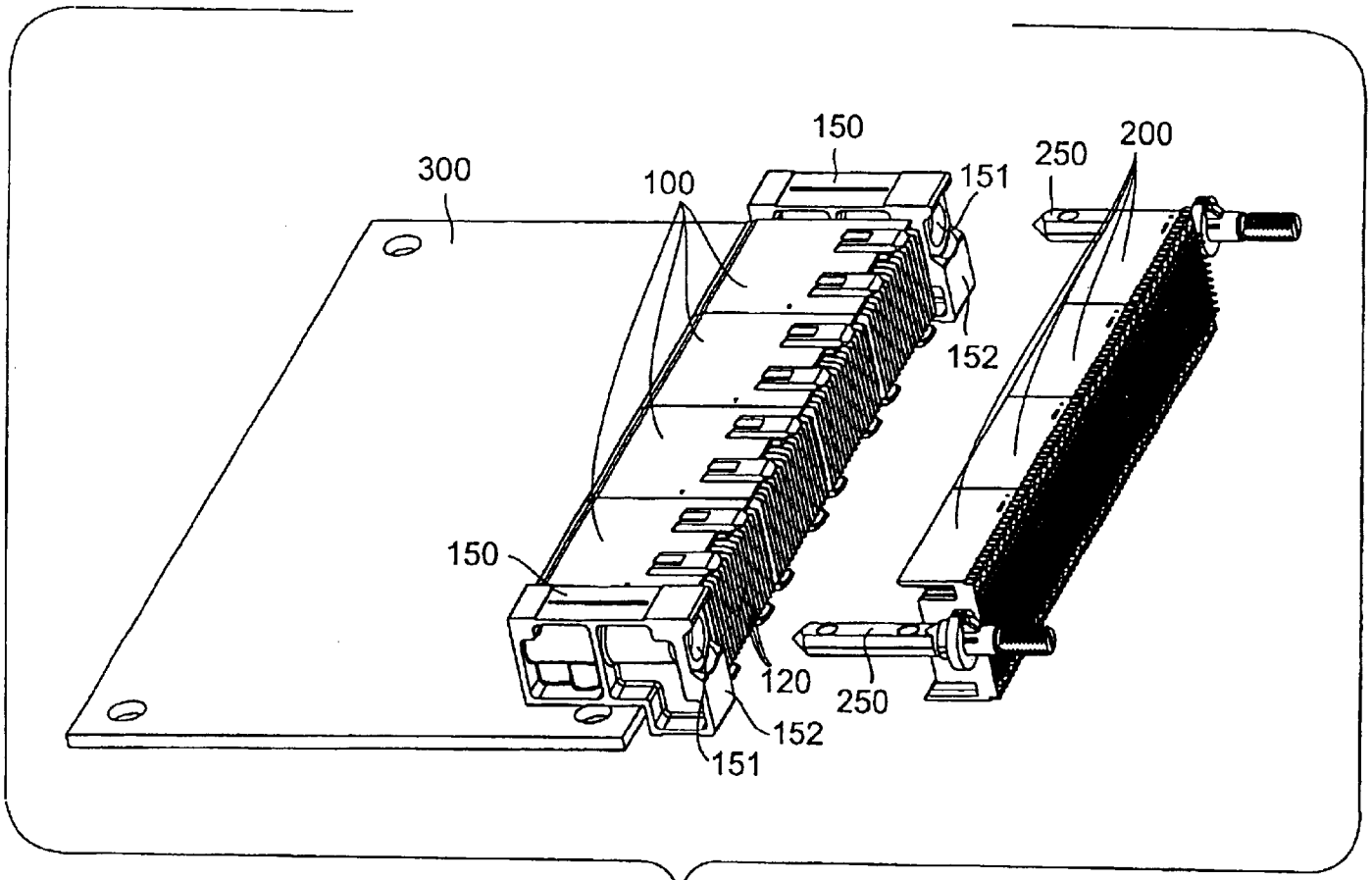
FIG. 15 is a diagram showing multiple first connectors mounted on a daughter board and corresponding multiple second connectors.
Figure 16:
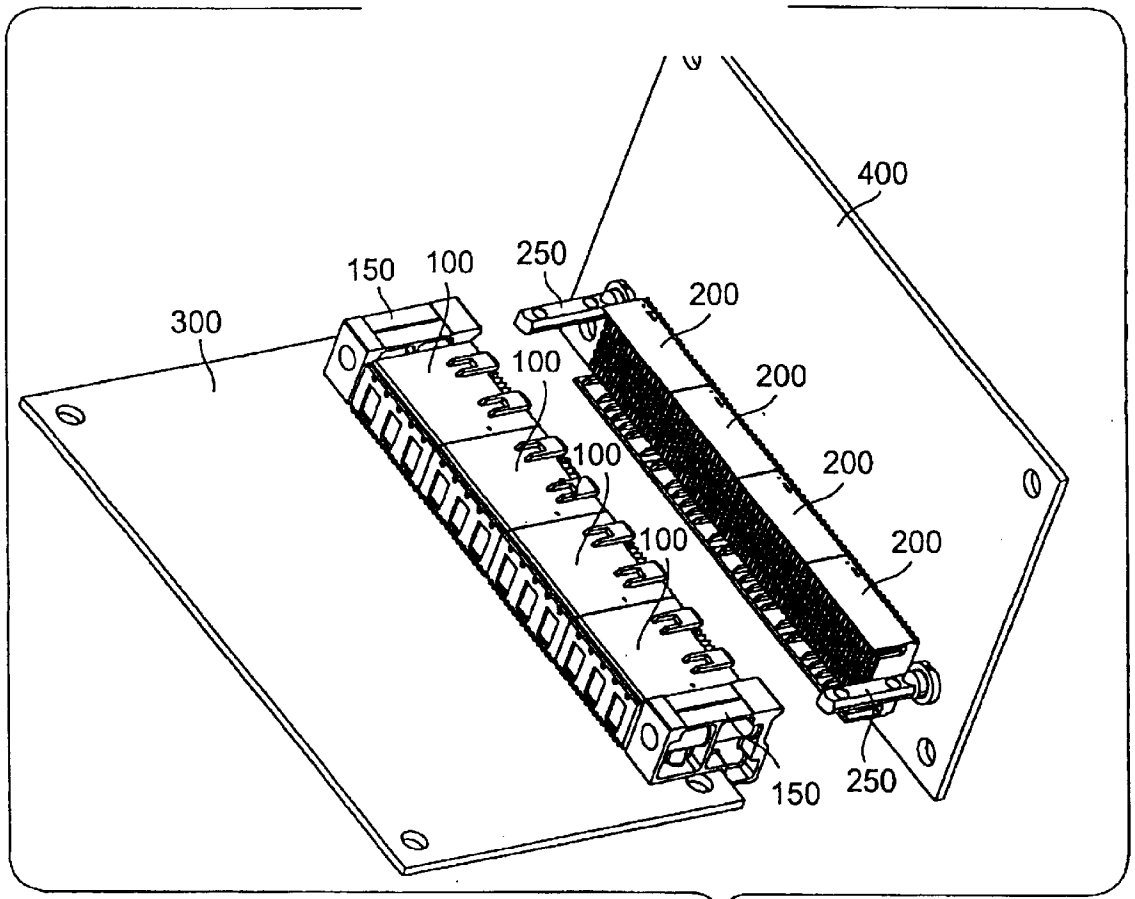
FIG. 16 is a diagram showing multiple first connectors mounted on a daughter board and corresponding multiple second connectors mounted on a motherboard.

FIG. 15 is a diagram showing multiple first connectors mounted on a daughter board and corresponding multiple second connectors. FIG. 16 is a diagram showing multiple first connectors mounted on a daughter board and corresponding multiple second connectors mounted on a motherboard.

In FIGS. 15 and 16, an array of four first connectors 100 are mounted on a daughter board 300. Guide catches 150 with receptacles 151 are installed on both ends of the array to accept guide posts 250 attached to second connectors 200, which are four in number corresponding to the four first connectors 100. The guide posts 250 to be inserted in the receptacles 151 of the guide catches 150 are installed on both ends of the second-connector array. According to the aspect shown in FIG. 16, the second connectors 200 are mounted in this state on a motherboard 400.

The housing 220 of the second connector 200 described above has walls on both sides which correspond to the sides of the arrayed substrates 120 as shown in FIG. 1. Thus, if multiple second connectors 200 are arranged as shown in FIG. 15 without proper measures, the array pitch of the second connectors 200 will not match that of the multiple first connectors 100.

To deal with this situation, out of the four second connectors 200 arranged as shown in FIGS. 15 and 16, the outer two second connectors have a housing with an outer side wall but without an inner side wall while the two second connectors 200 in the center have a housing without a side wall.

Figure 17:
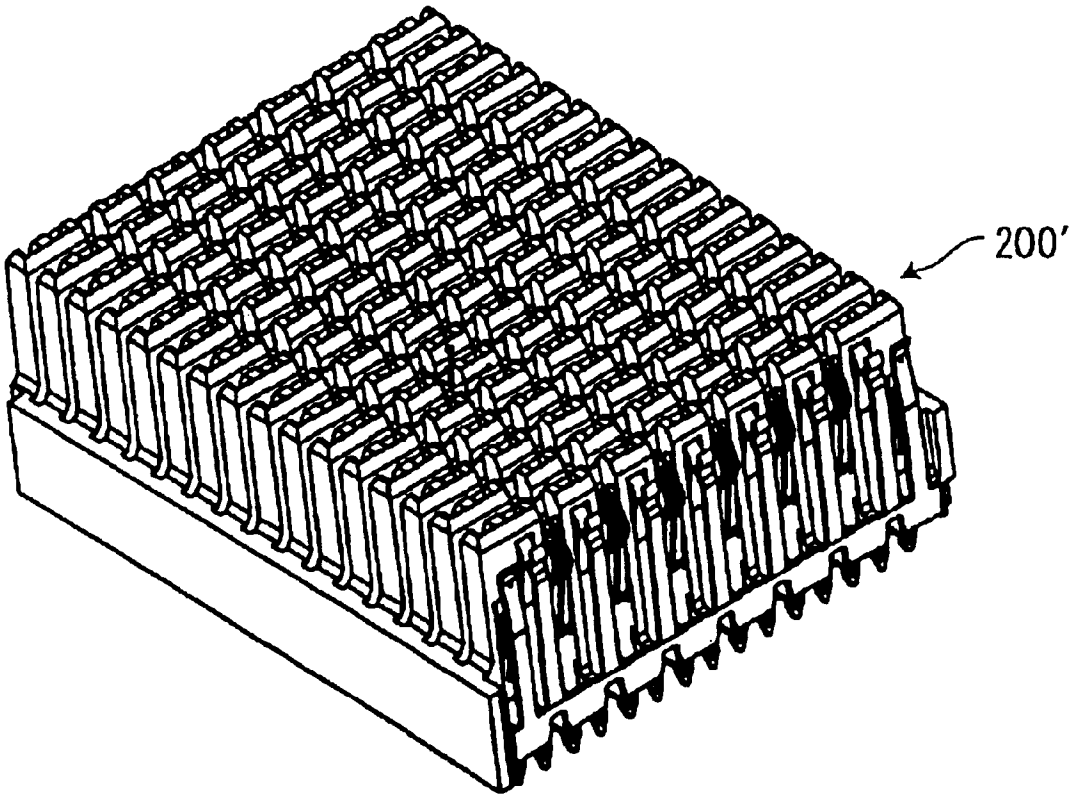
FIG. 17 is a perspective view showing a second connector without any side wall.

FIG. 17 is a perspective view showing a second connector 200' without any side wall.

In this way, by providing second connectors with only one side wall and second connectors without any side wall, it is possible to configure an electrical connector assembly with multiple first connectors and corresponding multiple second connectors, such as those shown in FIGS. 15 and 16.

As shown in FIGS. 15 and 16, the guide catches 150 on both ends of the arrayed first connectors 100 have their front faces protruding further than the front edges of the substrates 120 in the first connectors 100. This reduces the possibility of the substrates 120 being chipped or broken by being hit by something during handling.

Advantageously, being equipped with the rough guide mechanism for use at the initial stage of mating and the precision guide mechanism for use at the advanced stage of mating, the electrical connector assembly according to the present invention can start a mating using rough positioning without the need for accurate positioning at the initial stage of mating and proceed with the mating using precise positioning to provide a highly reliable mating with high precision.

What is claimed is:

1. An electrical connector assembly comprising:

a first connector having a plurality of terminals, a plurality of substrates equipped with lands connected to the terminals, contact sections to be connected to the a second connector, and a first housing which supports the plurality of substrates in an array;

a second connector having a plurality of female terminals which engage the contact sections of the substrates, and a second housing which supports the female terminals; and a rough guide mechanism which guides a mating between the first connector and second connector relatively roughly at an initial stage of mating, the rough guide mechanism having first guides installed at two locations at a certain distance from each other on a first side wall of the first housing, second guides installed on the first housing at two locations on a second side wall opposite the first side wall, being separated by a distance different from the distance between the first guides, and first complementary guides and second complementary guides installed in the second housing corresponding to the first guides and the second guides, respectively; and, a precision guide mechanism which guides the mating between the first connector and second connector relatively precisely at an advanced stage of mating the precision guide mechanism having chamfers created on corners of the substrates which are on the side of the contact sections and tapers created on the second housing corresponding to the chamfers.

2. The electrical connector assembly, according to claim 1, wherein the precision guide mechanism comprises a recess formed between the firs guides in the first housing; and a protrusion formed in the depth between the first complementary guides on the second housing and aligned with the recess.

* * * * *

UNITED STATES PATENT AND TRADEMARK OFFICE

CERTIFICATE OF CORRECTION

PATENT NO. : 6,866,549 B2
DATED : March 14, 2005
INVENTOR(S) : Kimura et al.

It is certified that error appears in the above-identified patent and that said Letters Patent is hereby corrected as shown below:

Column 8,
Line 50, after "between the" delete "firs" and insert -- first --.

Signed and Sealed this

Thirty-first Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,866,549 B2
DATED : March 15, 2005
INVENTOR(S) : Kimura et al.

It is certified that error appears in the above-identified patent and that said Letters Patent is hereby corrected as shown below:

Column 8,
Line 50, after "between the" delete "firs" and insert -- first --.

This certificate supersedes Certificate of Correction issued January 31, 2006.

Signed and Sealed this

Seventh Day of March, 2006

JON W. DUDAS
*Director of the United States Patent and Trademark Office*